United States Patent [19]

Kemmetmueller

[11] 4,152,843

[45] May 8, 1979

[54] APPARATUS FOR DELIVERING TREATING GAS TO BULK MATERIAL SUCH AS HOT COKE OR COAL SITUATED IN A CONTAINER

[75] Inventor: Roland Kemmetmueller, Vienna, Austria

[73] Assignee: Waagner-Biró Aktiengesellschaft, Austria

[21] Appl. No.: 864,435

[22] Filed: Dec. 27, 1977

[30] Foreign Application Priority Data

Dec. 30, 1976 [AT] Austria ..... 9816/76

[51] Int. Cl.[2] ..... F26B 9/08

[52] U.S. Cl. ..... 34/229; 34/57 A; 34/232; 34/241; 239/456

[58] Field of Search ..... 34/57 A, 57 R, 168, 34/224, 222, 229, 232, 241, 66, 67; 239/416, 417, 456, 514; 432/58

[56] References Cited

U.S. PATENT DOCUMENTS

| | | | |
|---|---|---|---|
| 3,861,862 | 1/1975 | Steever et al. | 34/57 A |
| 3,887,337 | 6/1975 | Descamps et al. | 34/57 A |
| 4,002,325 | 1/1977 | Herfeld | 34/57 A |

*Primary Examiner*—John J. Camby
*Assistant Examiner*—Larry I. Schwartz
*Attorney, Agent, or Firm*—Steinberg & Blake

[57] ABSTRACT

An apparatus for treating bulk material such as hot coke or coal by supplying a treating gas thereto includes a container in which the bulk material is situated during treatment thereof. A gas distributor extends into the interior of this container and includes a plurality of coaxial elongated pipes which have open ends in the interior of the container, an elongated bar extending coaxially along the innermost one of said pipes and also having a free end situated in the interior of the container. The ends of the several pipes which are in the container are open and are enlarged while the inner free end of the bar in the container is also enlarged, and a moving structure is operatively connected with at least one of the pipes as well as the bar for axially moving the same relative to each other so as to adjust the positions of the free end of the bar and the open ends of the pipes with respect to each other. The pipes define between themselves passages for treating gas while the bar and the innermost pipe also define between themselves a passage for a treating gas. Thus with the above structure by regulating the axial positions of the pipes and bar with respect to each other it is possible to provide at the open ends of the pipes and by way of the enlarged end of the bar the equivalent of adjustable nozzles through which a treating gas can flow into the interior of the container.

8 Claims, 5 Drawing Figures

Fig. 1
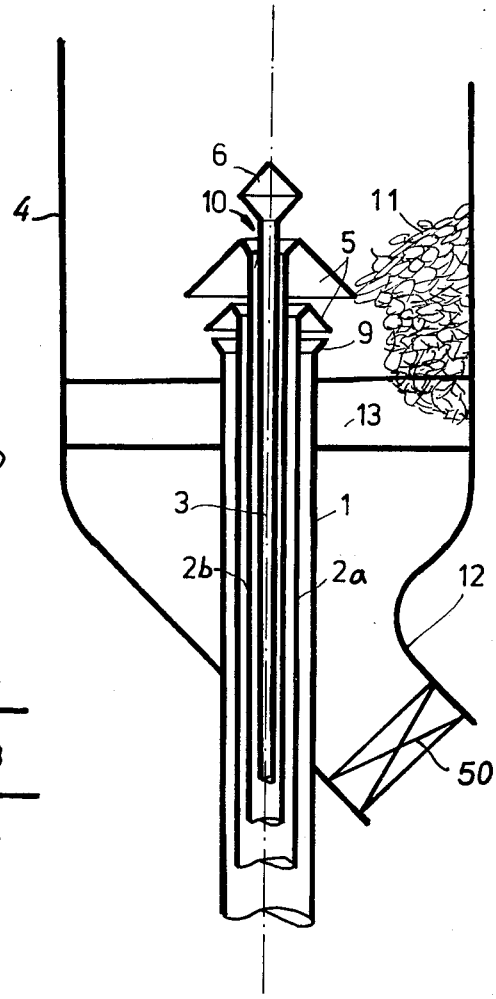
Fig. 2
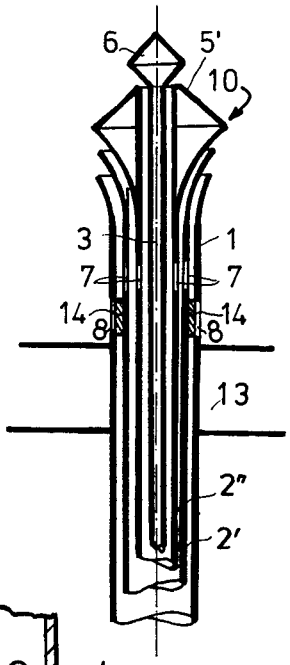
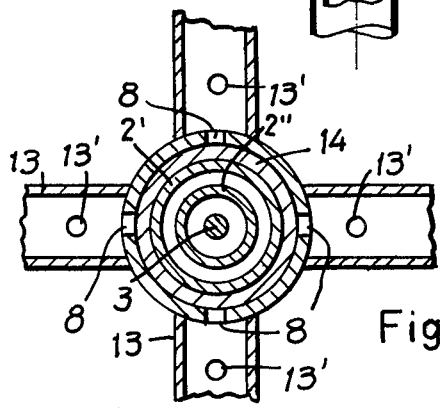
Fig.5
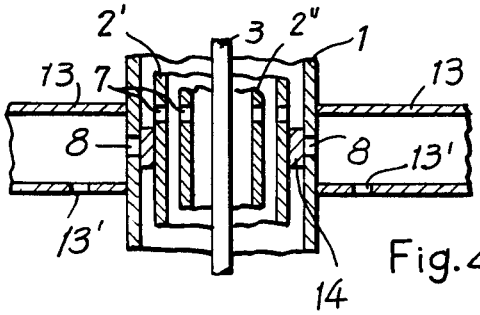
Fig.4
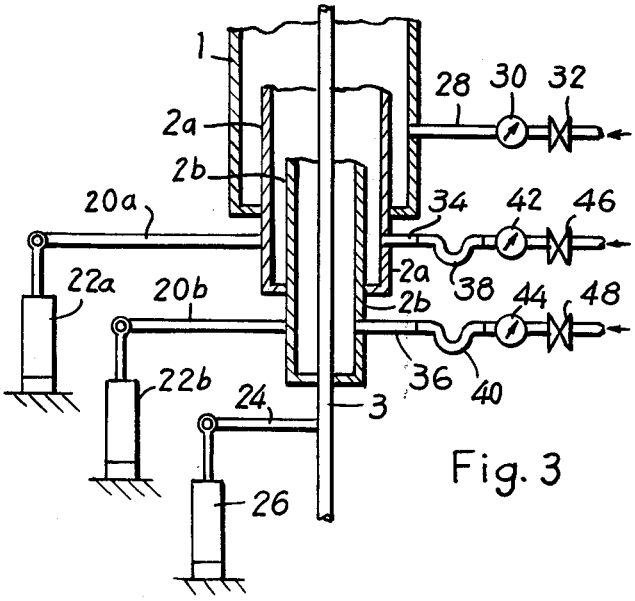
Fig. 3

APPARATUS FOR DELIVERING TREATING GAS TO BULK MATERIAL SUCH AS HOT COKE OR COAL SITUATED IN A CONTAINER

BACKGROUND OF THE INVENTION

The present invention relates to apparatus for treating bulk material with a gaseous treating fluid.

Thus, the present invention may be utilized in connection with gas distributors for treating a bulk material such as hot coke or coal in order to distribute to such materials a treating gas which in the case of the hot coke will cool the latter or in the case of coal will dry the latter.

It is already known to utilize gas distributors in devices for cooling hot coke, in installations for cooling and drying coke, and such gas distributors are also utilized in coal driers. However, with these known constructions there is the disadvantage that the distribution of the gas cannot be adapted to the particular amount of bulk material which is present. Moreover, conventional gas distributors often contribute toward formation of bridges in the bulk material, so that as a result difficulty is encountered in the discharge of the bulk material from the container in which it is situated.

SUMMARY OF THE INVENTION

It is accordingly a primary object of the present invention to provide a construction which will avoid the above drawbacks.

In particular, it is an object of the present invention to provide a gas distributor of the above general type which can be adjusted.

Thus, it is an object of the present invention to provide a gas distributor having components which may be adjusted for regulating the flow of treating gas.

Also it is an object of the present invention to provide a gas distributor having structure which may be moved for the purpose of loosening the bulk material.

In accordance with the invention the gas distributor includes a plurality of coaxial pipe means extending into the interior of a container means for the bulk material and having open ends therein. Within the innermost of these pipe means there is a coaxial elongated bar having a free end in the interior of the container means, and this free end of the bar as well as the open ends of the several pipe means situated in the container means are all enlarged so as to define between themselves outlets for the gas delivered to the interior of the container means through these pipe means. A moving means is operatively connected with at least one of the pipe means as well as the bar for axially moving the same so as to adjust the axial positions of the pipe means and bar with respect to each other, thus adjusting the positions of the enlarged ends of these components with respect to each other, so that in this way it is possible to adjust the size of the outlets through which the gas flows to the interior of the container means, these outlets thus forming the equivalent of adjustable nozzles. Moreover, the outermost one of the pipe means has a side wall formed with and opening passing therethrough, and this opening is arranged to be uncovered when the gas distributor is in a closed position, so that in this way a cooling or heating medium can be delivered to the bulk material at a relatively low elevation. Preferably, this latter opening in the outermost pipe means communicates with the hollow interior of a support for the outermost pipe means, and this latter support is itself formed with an opening passing therethrough so that it is through this support that the gas can be delivered at a relatively low elevation when the gas distributor is closed. Moreover, the enlarged end of the bar which can act as an adjustable nozzle with respect to the open end of the innermost one of the pipe means preferably takes the form of an enlarged head which can be moved within the container means in response to axial movement of the bar so as to act as a device for vibrating or loosening the bulk material situated within the container means.

BRIEF DESCRIPTION OF DRAWINGS

The invention is illustrated by way of example in the accompanying drawings which form part of this application and in which:

FIG. 1 is a schematic fragmentary sectional elevation of one possible embodiment of the structure according to the invention;

FIG. 2 is a fragmentary sectional elevation of another embodiment of a structure according to the invention;

FIG. 3 is a schematic illustration of structure for axially moving the several pipe means and central bar as well as for supplying gas at a predetermined pressure to the interiors of the several pipe means;

FIG. 4 is a fragmentary sectional elevation of a further embodiment of the invention; and FIG. 5 is a sectional plan view of the structure of FIG. 4.

DESCRIPTION OF PREFERRED EMBODIMENTS

Referring to FIG. 1, there is schematically and fragmentarily illustrated therein a container means 4 which is adapted to contain a material in bulk, such as hot coke or coal. A gas distributor means 10 according to the present invention is situated coaxially along the container means 4, extending into the interior thereof as illustrated schematically in FIG. 1. By way of the gas-distributing means 10 it is possible to supply a gas for cooling or heating the bulk material 11 which is shown schematically in FIG. 1. This gas will be uniformly distributed to the interior of the container means 4 for treating the bulk material 11 therein in a manner which will be apparent from the description which follows.

The gas-distributing means 10 includes an outermost pipe means 1 in which there is coaxially situated an inner pipe means 2*a*, and in the illustrated example the pipe means 2*a* has an innermost pipe means 2*b* situated in the interior thereof. These pipe means have tubular walls which are coaxial and spaced from each other so that they define gas passages between themselves. Situated within the innermost pipe means 2*b* is an elongated bar 3 which is coaxial with the pipe means 2*b* while being spaced inwardly from the inner surface thereof so as to define therewith an additional passage for a treating gas.

As is apparent from FIG. 1, the upper ends of the several pipe means 1, 2*a*, 2*b* are open in the interior of the container means 4. The outermost pipe means 1 has at its open upper end an outwardly flaring enlargement 9 while the pair of pipe means 2*a* and 2*b* are provided at their open ends with enlargements 5 having the illustrated configuration of hollow truncated cones. It will be seen that the bottom end of the enlargement 5 of the pipe means 2*a* has a diameter greater than the enlargement 9 while the bottom end of the enlargement 5 of the pipe means 2*b* has a diameter greater than the next lower enlargement 5. However, in the embodiment of FIG. 2 it will be seen that the several pipe means 1, 2', and 2'', which respectively correspond to the pipe means 1, 2a, 2b of FIG. 1 are provided at their open upper ends with outwardly flaring enlargements similar to the enlargement 9 of FIG. 1. In the case of the innermost pipe means 2'' of FIG. 2, however, it will be seen that this pipe means is provided with a larger annular enlargement 5' which may be solid or hollow and which as a result of this configuration is capable of acting as a device for displacing the bulk material.

In both embodiments of the invention the pair of inner pipe means can be axially moved, and also the bar 3 can be axially moved. Any suitable hydraulic or mechanical moving means may be provided for this purpose. Thus, FIG. 3 shows schematically how the pair of pipe means 2a and 2b are respectively fixed at their exterior lower end regions to bars 20a, 20b which are respectively connected at their outer ends to the schematically illustrated adjustable hydraulic units 22a, 22b, so that by operation of these hydraulic units it is possible to control the elevations of the pair of pipe means 2a, 2b independently of each other, and of course a similar structure is operatively connected with the pair of pipe means 2', 2'' of FIG. 2. In addition FIG. 3 shows schematically how a bar 24 is fixed to and extends from the lower end of the bar 3 and is operatively connected with a hydraulic unit 26 which enables the axial position of the bar 3 to be adjusted. Of course the bar 3 extends fluid-tightly through the lower end of the pipe means 2b, while the latter extends fluid-tightly through the lower end of the pipe means 2a, and the pipe means 2a in turn extends fluid-tightly through the lower end of the outermost pipe means 1 which is stationary.

Moreover, FIG. 3 illustrates schematically a means for supplying one or more different gases at predetermined pressures to the interiors of the several pipe means. This gas-supply means includes a supply tube 28 communicating with the interior of the outermost pipe means 1 and carrying a pressure gauge 30 as well as a valve 32 which can be adjusted to control the flow of gas through the pipe or tube 28 into the pipe means 1. This tube 28 communicates with a source of any desired treating gas which is at a predetermined temperature and the pressure of which in the interior of the pipe means 1 can be controlled by the valve 32. In the same way, a pair of supply tubes 34 and 36 respectively communicate with the interiors of the pipes 2a, 2b, these supply tubes 34 and 36 respectively having flexible portions 38, 40, formed by suitable hoses, and also carrying pressure gauges 42, 44 and valves 46, 48. These tubes 34 and 36 also communicate with any suitable source of gas. Thus with this construction it is possible to provide a given gas at a selected pressure to the interiors of the several pipe means. By operating the moving means shown at the lower left portion of FIG. 3 it is possible to control the axial positions of the several pipe means with respect to each other. In addition, it will be seen that the inner free end of the bar 3 is provided in the interior of the container means 4 with an enlarged head end 6 the position of which with respect to the upper open end of the pipe means 2b can be adjusted as described above. Thus by way of these adjustments it is possible to control the positions of the enlargements at the upper open ends of the several pipe means and the enlargement 6 at the upper end of the bar 3 with respect to each other to provide in this way between these enlargements the equivalent of adjustable outlet nozzles through which one or more gases can be delivered in a controlled manner to the interior of the container means 4 for achieving in this way the best possible treatment of the bulk material 11.

Moreover, it will be seen that the enlarged end 5 of the pipe means 2a can be moved to a position closing the outlet 9 of the outermost pipe means 1, while the enlarged end 5 of the pipe means 2b can also be moved to a position closing the outlet of the pipe means 2a. In addition the enlargement 6 can be moved to a position closing the upper open end of the innermost pipe means 2b. Thus it is possible for these enlargements not only to provide the equivalent of adjustable nozzles but also to close the outlets for the gas passages.

Furthermore, the size of the enlargements is such that the bulk material cannot enter into the interiors of the several pipe means. Thus each enlargement 5, 6 acts in a manner of an umbrella for the next-lower pipe means with the enlargement 6 acting the same way for the innermost pipe means 2b, so as to prevent the bulk material from having access to the interiors of the pipe means. Thus the pipe means cannot become plugged at their interiors by the bulk material.

With the supply means as shown at the right of FIG. 3 it is possible to control the pressures of the gas in the interiors of the several pipe means so that even if these interiors of the several pipe means provide gas-flow paths of different cross-sectional areas, nevertheless the same amount of gas can be delivered to the interior of the container means through each of the individual pipe means.

It will be seen that the above advantages of the embodiment of FIG. 1 are also achieved by the embodiment of FIG. 2.

The particular construction shown in the drawings and described above is especially suitable for cooling hot coke in a dry coke quenching installation, in which the glowing coke is quenched by way of an inert cooling gas. However, the structure of the invention also is especially suitable for drying coal in an installation in which the coal is heated by an inert hot gas so as to be dried thereby.

As is apparent from FIG. 1, the container means 4 is provided with an outlet 12 which can be controlled by a suitable schematically illustrated gate structure 50, and in much the same way the supply of bulk material to the interior of the container means 4 can be controlled by a suitable gate structure at the top end of the container means 4. When the material is discharged out of the container means 4 by way of the outlet 12, it is possible for the bulk material easily to form bridges in the interior of the container means 4, so that the discharge of the bulk material is rendered difficult. In order to avoid this disadvantage, the moving means connected to the bar 3 is actuated to move the latter axially up and down, and at the same time the axially movable pipe means are also moved up and down, if desired, so that the structure operates in a manner similar to a poker, with the head 6 of the bar 3 and the enlargement 5' of the pipe means 2'' of FIG. 2 being particularly effective for this purpose. In particular, the upward movement of the bar 3 or either one or both of the interior pipe means will act to break up bridges which might otherwise remain in the bulk material to render the discharge thereof difficult.

As is shown in FIG. 1, a plurality of horizontally extending supporting bars 13 are fixed at their outer ends to the inner surface of the container means 4 and at their inner ends to the outer surface of the outermost pipe means 1 so as to support the latter. These several supporting bars 13 extend radially out from the pipe means 1 to form a spider-type of support for the pipe means 1.

In the embodiment of FIG. 2 the distributor 10 includes an outermost pipe means 1 which just above the supporting bars 13 is formed with a plurality of openings 8 which in the operative position of the distributor 10 of FIG. 2 are closed by a closure means formed by a ring 14 which is fixed to the outer surface of the pipe means 2'' and which has an axial length great enough to extend across and cover the openings 8 in the operative position of the distributor means shown in FIG. 2. However, when this distributor means is placed in its closed position, the pipe means 2'' will be lowered with respect to the pipe means 1, to close the upper end of the latter, but at this time it will be seen that the openings 8 will become uncovered, so that when the distributor means is closed it is possible in this way to deliver treating gas to the interior of the container means through these openings 8. Thus, when the gas-distributing means of FIG. 2 is closed it is possible in this way to supply a treating gas through the openings 8 at a lower elevation than the elevation at which gas is normally delivered to the interior of the container means when the gas-distributor means is in its operative position. This feature has a particular advantage inasmuch as when the container means 4 is filled only to a relatively small extent it is still possible to carry out a treatment of the bulk material.

However, an even greater advantage results from this construction, particularly in connection with installations for cooling hot coke. Thus, with this construction of FIG. 2 when the bunker 4 is initially filled with coke the coke which first is introduced into the bunker so as to become situated at a relatively low elevation therein can immediately be quenched, so that in this way it is not necessary to start the quenching only after the entire bunker is filled.

In this connection it is of course also possible to situate the openings 8 at an elevation somewhat lower than the bars 13.

Furthermore, as is shown in FIG. 4, it is possible for the bars 13 to be made of hollow elements while the openings 8 are situated at an elevation where they communicate with the interiors of the hollow supporting bars 13. With this construction when the distributor is placed in a closed position, the closure ring 14 shown in FIG. 4 in the operating position of the distributing means will be lowered downwardly beyond the openings 8 so that these openings 8 will become uncovered to enable gas to flow therefrom into the interiors of the hollow supporting bars 13. These bars are provided at their lower portions with discharge openings 13', this construction also being shown in FIG. 5, so that in this way the supporting bars 13 themselves act as part of the gas distributor enabling a treating gas to be delivered to the interior of the container means at a relatively low elevation for the above purposes.

Of course in order to close the gas-distributor means it is also possible to raise the pipe means 2'' so as to uncover the openings 8, so that in this way the gas which is delivered through these openings 8 can be supplied directly to the interior of the outermost pipe means 1. However it will be seen that in the example of FIGS. 2–4 the pipe means 2' is formed itself in the side wall with openings 7 situated higher than the closure ring 14 so that if the latter is lowered to uncover the openings 8 a supply of gas to the latter can be supplied through the interior of the pipe means 2', this gas flowing through the openings 7 of the latter to reach the openings 8 in this case. In the illustrated example it will be seen that the innermost pipe means 2'' is also formed with openings 7 passing through a tubular wall portion thereof. By way of these openings 7 it is also possible to achieve a more uniform flow of gas both along the interiors of the several pipe means as well as through the openings 8 when the latter are uncovered.

In accordance with the invention it is possible to provide for the gas distributor means any desired number of coaxial pipe means so that it is possible in this way to provide for gas outlets in the interior of the container means 4 at desired elevations therein. Moreover, the configuration of the several pipe means and the bar 3 at their upper ends may be adapted to the particular material which is to be handled so that for a particular material the enlargements 5, 6, 9, or 5' in FIG. 2, can be given a configuration which will provide for a particular material which is to be handled a gas-outlet structure of a particular configuration or construction, to achieve the best possible results for a particular material.

What is claimed is:

1. In an apparatus for treating bulk material such as hot coke which is to be cooled or coal which is to be dried, container means for containing bulk material during the treatment thereof, a plurality of coaxial pipe means extending into the interior of said container means for supplying one or more treating gases thereto, said plurality of coaxial pipe means respectively including tubular side walls which are spaced from each other to define gas passages between themselves, an elongated bar situated coaxially within the innermost of said pipe means while being spaced therefrom so that a gas can also flow in the interior of the innermost of said pipe means along said bar, moving means operatively connected to at least one of said pipe means and said bar for moving at least said one pipe means and said bar axially for adjusting the axial position of said bar and said pipe means with respect to each other, said plurality of pipe means respectively having open ends in the interior of said container means and respectively being enlarged at said open ends which are displaced axially one with respect to the other upon movement of at least said one pipe means by said moving means, said bar also having in the interior of said container means an enlarged end the position of which can be changed with respect to the open end of said innermost pipe means upon axial movement of said bar by said moving means connected thereto, whereby operation of said moving means will regulate the positions of said enlarged ends of said pipe means and said enlarged end of said bar with respect to each other for defining at said enlarged ends adjustable outlets acting as adjustable nozzles through which the treating gas flows into the interior of said container means.

2. The combination of claim 1 and wherein said enlarged ends of said plurality of pipe means form also a closure means for closing at least one of said passages in one position of at least said one pipe means while said enlarged end of said bar forms an adjustable nozzle outlet with the open end of said innermost pipe means.

3. The combination of claim 2 and wherein at least one of said pipe means carries at said open end thereof an enlargement of a configuration suitable for displacing the bulk material to act in a manner similar to a poker.

4. The combination of claim 1 and wherein at least one pipe means situated within the outermost of said pipe means is formed at its tubular side wall with at least one opening passing therethrough so that a gas which is to be distributed can flow through the latter opening.

5. The combination of claim 1 and wherein a gas-supply means communicates with said plurality of pipe means for delivering thereto gas which is to be distributed at pressures which are respectively adjustable for the plurality of pipe means, so that by adjusting said pressures for said plurality of pipe means it is possible to achieve a control for the amounts of gas which are delivered in said container means at different locations where said open ends of said plurality of pipe means are situated.

6. The combination of claim 1 and wherein said plurality of pipe means have a generally upright attitude while having said open ends situated at the top thereof in the interior of said container means, said plurality of pipe means and said bar forming a gas-distributing means capable of being placed in a closed position by said moving means, and the outermost one of said plurality of pipe means having a side wall formed with at least one opening passing therethrough, and the pipe means which is situated next to and surrounded by said outer most pipe means carrying a closure means for closing said opening of said outermost pipe means in a normal operating position of said gas-distributing means, said closure means uncovering and thus opening said opening of said outermost pipe means in said closed position of said gas-distributing means for permitting a gas to be delivered into said container means at a relatively low elevation when said gas-distributing means is in said closed position thereof.

7. The combination of claim 6 and wherein a plurality of substantially horizontal bars are fixed to said container means at an inner surface thereof and extend therefrom up to and are fixed to said outermost pipe means for supporting the latter, at least one of said horizontal bars being hollow and being formed in a wall portion thereof with an opening communicating with said opening in said wall of said outermost pipe means, so that when said gas-distributing means is closed the gas which is delivered to the interior of said container means will flow through said opening of said outermost pipe means into said hollow horizontal bar and out through said opening thereof to reach the interior of said container means.

8. The combination of claim 1 and wherein said enlargement at the end of said bar which is situated within said container means is in the form of a head cooperating with the end of said innermost pipe means in said container means to provide an adjustable nozzle therewith while also being axially movable with respect to material in said container means to move the latter material for the purpose of loosening the same if necessary.

* * * * *